US005778980A

United States Patent [19]

Comeau et al.

[11] Patent Number: 5,778,980

[45] Date of Patent: Jul. 14, 1998

[54] MULTICUT CASING WINDOW MILL AND METHOD FOR FORMING A CASING WINDOW

[75] Inventors: Laurier E. Comeau; Elis Vandenberg; Ian Gillis, all of Alberta, Canada

[73] Assignee: Baroid Technology, Inc., Houston, Tex.

[21] Appl. No.: 654,984

[22] Filed: May 29, 1996

[51] Int. Cl.[6] ..... F21B 7/08; F21B 29/06

[52] U.S. Cl. ..... 166/298; 166/117.6; 166/382

[58] Field of Search ..... 166/55.7, 117.5, 166/117.6, 298, 382

[56] References Cited

U.S. PATENT DOCUMENTS

| | | | |
|---|---|---|---|
| 5,154,231 | 10/1992 | Bailey et al. | 166/117.6 X |
| 5,277,251 | 1/1994 | Blount et al. | 166/117.5 |
| 5,301,760 | 4/1994 | Graham | 175/61 |
| 5,322,127 | 6/1994 | McNair et al. . | |
| 5,335,737 | 8/1994 | Baugh | 175/61 |
| 5,431,223 | 7/1995 | Konopczynski | 166/117.5 |
| 5,439,051 | 8/1995 | Kennedy et al. | 166/50 |
| 5,467,819 | 11/1995 | Braddick | 166/117.6 |

FOREIGN PATENT DOCUMENTS

| | | |
|---|---|---|
| 0 353 962 A2 | 7/1989 | European Pat. Off. . |
| 0 442 675 A2 | 2/1991 | European Pat. Off. . |
| 2 227 038 | 7/1990 | United Kingdom . |
| 2 258 479 | 2/1993 | United Kingdom . |

OTHER PUBLICATIONS

Weatherford fishing and Rental Tools, "Whipstocks and Whipstock Mills" brochure, published Dec. 1994 by Weatherford International Incorporated, P.O. Box 27608 Houston, Texas 77227.

Front and back cover and pp. 2826–2830 of the TIW 1994–95 General Catalog, published 1993 by TIW Corporation, P.O. Box 35729, Houston, Texas 77235.

*Primary Examiner*—David J. Bagnell

*Attorney, Agent, or Firm*—Browning Bushman

[57] ABSTRACT

A single trip tool and method for cutting a subsurface window through a well casing and installing an anchoring and orienting sleeve in the casing adjacent the window for subsequent downhole well procedures and equipment installation. A mill held in position within the casing by a hydraulic and weight-set tubular anchor sleeve is used to cut multiple vertical slots in the casing wall to form a single, large window. An indexing mechanism controls circumferential placement of the mill to ensure contact between adjacent slots. The mill is supported for rotation and longitudinal movement by a carriage mount that advances along dual sloping rails causing the mill to form an increasingly deeper cut during its initial cutting movement. Following formation of the window, the mill is retrieved leaving the anchoring sleeve in place for subsequent well procedures. A second embodiment anchors and orients the cutting assembly with an internally contoured coupling that is part of the casing string.

35 Claims, 10 Drawing Sheets

MULTICUT CASING WINDOW MILL AND METHOD FOR FORMING A CASING WINDOW

BACKGROUND OF THE INVENTION

The present invention is related to the invention described and claimed in U.S. patent application Ser. No. 08/496,504, now U.S. Pat. No. 5,579,829 filed on Jun. 29, 1995, and assigned to the same Assignee as that of the present invention.

The present invention relates generally to the formation of openings in well casings at a subsurface location within an existing well. More specifically, the present invention relates to a tool, system and method for cutting a window through the wall of a well casing at a desired subsurface location within the well with the window having desired dimensions and a desired orientation permitting subsequent drilling of a lateral well bore through the window. The present invention also relates to the provision of subsurface anchoring means that may be installed after the casing is run or may be installed in the casing string as the casing is run to function as an anchoring and orienting mechanism for the window cutting process as well as for subsequent operations conducted after the window is cut.

Formation of a lateral well bore from a main well bore is well known in the prior art. Where the lateral bore is formed from an existing cased well, it is necessary to form an opening through the casing at the point the lateral well is to begin. The equipment used for this process usually includes a whipstock having a slanted guide surface that is used to direct a rotary mill against the casing wall. It is common to begin the process with a small "starting mill" that forms an initial cut used as a guide for a subsequent, larger cut made by a "window mill". Using this procedure necessitates at least two trips into the well, the first for the starting cut and the second for the window cut. Another shortcoming associated with prior art deflecting tools is that commonly used whipstock and mill devices allow the mill to rest against the deflecting guide surface causing the guide surface to be milled along with the casing wall. This destruction of the guide surface shortens the useful life of the deflecting tool.

After cutting the window, drilling equipment is lowered into the well to form the lateral well bore. The whipstock used to initially form the window may also serve to direct the drill bit through the window and into the formation. While the presence of the whipstock assists in directing the drill bit and other equipment through the casing window, its presence presents an obstruction to the casing below the whipstock. Removal of the whipstock to obtain access to the casing below complicates re-entry of equipment or tools into the lateral bore.

BRIEF DESCRIPTION OF THE INVENTION

The tool system and method of the present invention provide a novel single trip technique for forming a subsurface window in a well casing. In a preferred form of the invention, the window is formed and a subsurface anchoring and orienting sleeve is installed in a single trip of the tool into the well. After installation of the anchoring and orienting sleeve and formation of the window, a drilling assembly or other subsurface equipment or tools may be re-engaged with the sleeve to be automatically oriented and anchored relative to the window.

The tool is initially oriented and then anchored at a desired subsurface location within the well casing adjacent an area where a window is to be cut through the casing wall. Anchoring of the tool is accomplished by activating or "setting" hydraulically operated slips that lock against the internal casing wall to prevent downward movement of the tool. Weight is then applied to the tool through the drill string assembly to set weight-set slips that prevent upward movement of the tool. Initiation of the setting procedure with hydraulically set slips reduces the likelihood of premature setting or other setting problems that may occur when mechanically set slips using drag blocks or other restricting devices are employed in the setting mechanism. The hydraulic setting also prepares the tool for subsequent release from an anchoring and orienting sleeve that contains the slips and also contains an orienting arrangement for holding and orienting equipment or tools after the window is formed. When the tool is retrieved, a substantially large central sleeve opening allows access to the well below the sleeve.

The window is formed by cutting multiple longitudinally extending, contacting openings in the casing wall. The individual openings combine to produce a window having a desired circumferential development. An indexing mechanism is employed to move the cutting device of the tool angularly by a desired amount to bring the wall cut into contact with the preceding cut. The indexing mechanism also functions to hold the tool in place while the cut is being formed. The number of cuts and the angular indexing of the cutting device are selected as a function of the circumferential size of the cutting device's cut and the desired window size.

An important feature of the present invention is that the cutting device is supported for movement in the tool such that the cutting action is directed solely to the casing and not against the deflecting surface.

The preferred form of the cutting device of the present invention is a rotary mill that is mounted for movement through the tool by a carriage that permits rotary, longitudinal and radial movement of the cutting device. The carriage rides on a longitudinally extending ramp that slowly advances toward the casing wall and then parallels the casing wall. As the carriage follows the ramp, the mill is slowly moved into contact with the casing wall to begin the cut. As the carriage advances up the ramp, it continues to make an increasingly deeper cut in the casing as it moves longitudinal, finally moving parallel to the casing axis after a full width cut is established. This incremental increase in cutting depth during the initial cutting action assists the mill in starting and maintaining a substantially straight track.

From the foregoing it will be understood that a primary object of the present invention is to provide an apparatus and process for forming a subsurface window in a well casing on a single trip into the well.

Another object of the present invention is to provide a device that forms multiple, adjacent, longitudinal cuts in a casing wall with a single cutting tool so that the cuts combine to form a single window through the casing wall.

Still another object of the present invention is to provide a single trip method for forming a subsurface window in the casing of a well and installing an anchoring and orienting sleeve that is used during the window formation and that also provides an anchoring and orienting mechanism for subsequent well procedures and equipment installation.

An important object of the present invention is to provide a cutting tool that cuts the casing wall without cutting the deflecting tool surface and that may be advanced into increasing cutting engagement with the casing to initiate the cut in a manner to maintain a relatively straight cutting path.

An object of a modified form of the present invention is to employ a coupling having a contoured internal surface in the casing string of a well to subsequently serve as an anchoring and orienting area for the cutting assembly of the present invention while maintaining a full drift opening through the casing.

These and further objects, features and advantages of the present invention become more fully described in the following specification, drawings and claims.

DETAILED DESCRIPTION OF THE PREFERRED EMBODIMENTS

Figure 1A:
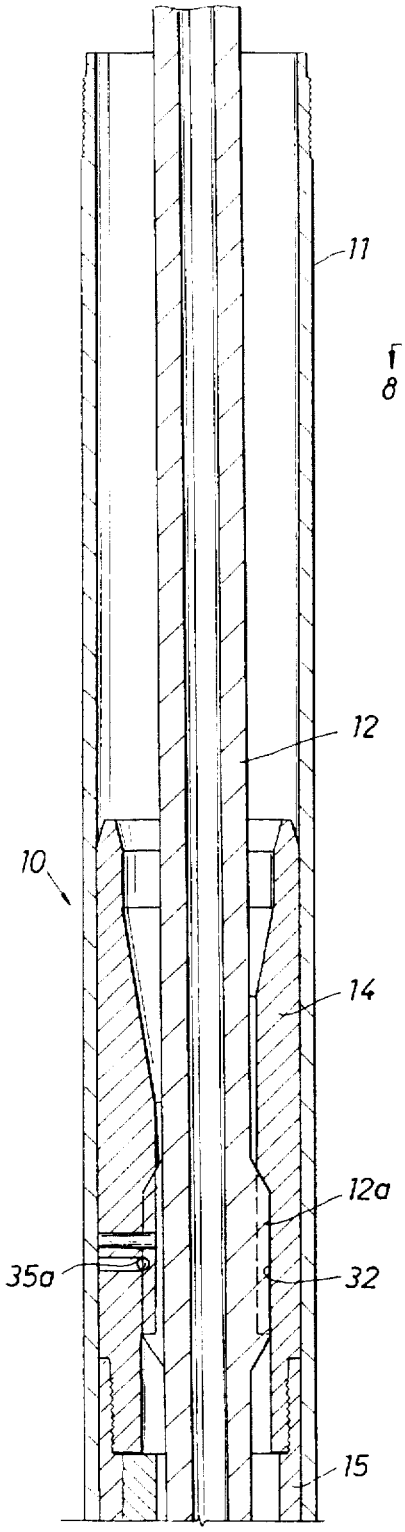
FIGS. 1A–1F are vertical elevations, in six segments, illustrating the tool of the present invention as it is initially being run into position within a well casing.
Figure 1B:
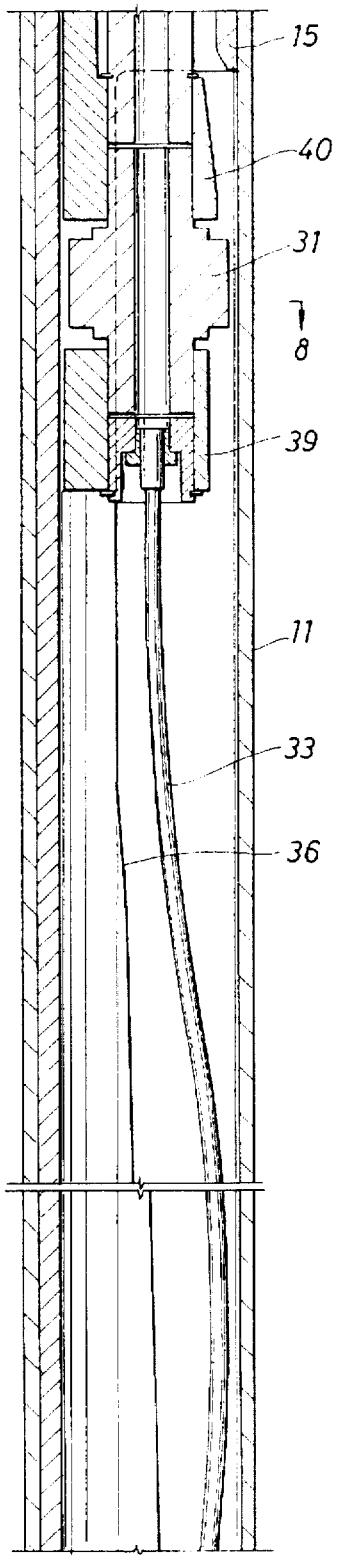
Figure 1C:
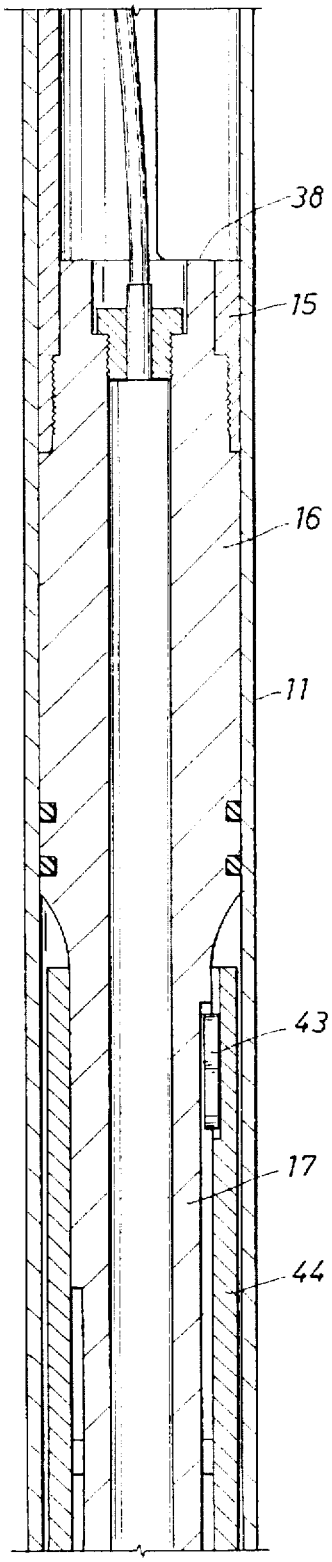
Figure 1D:
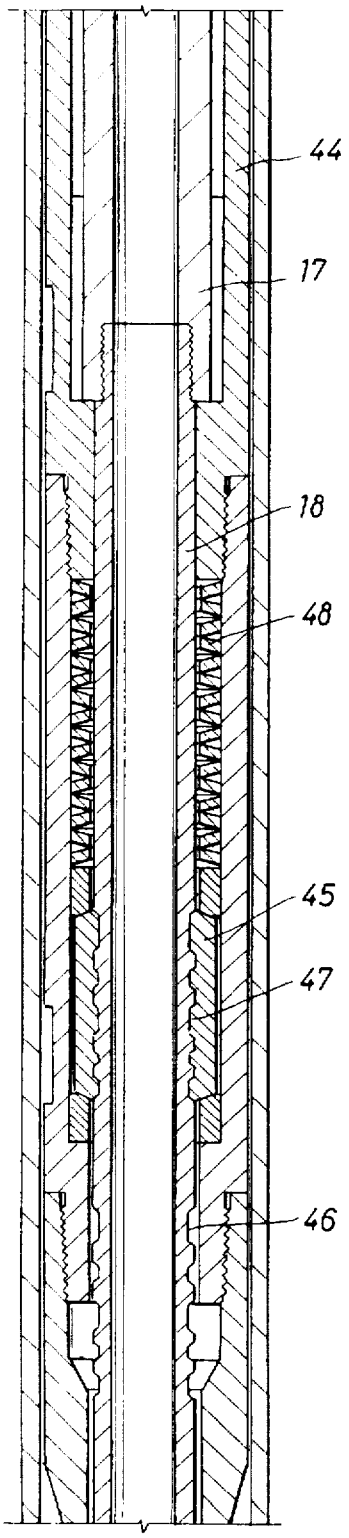
Figure 1E:
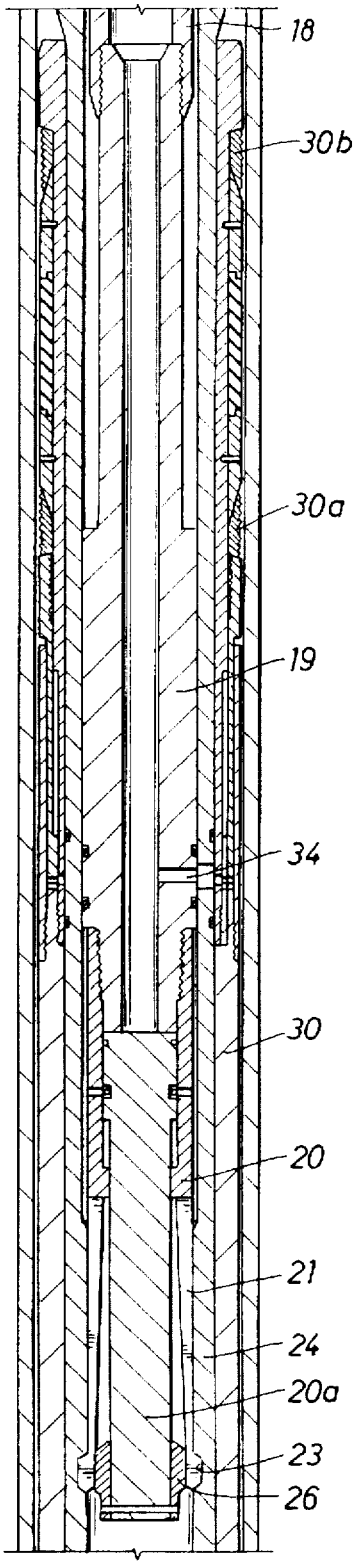
Figure 1F:
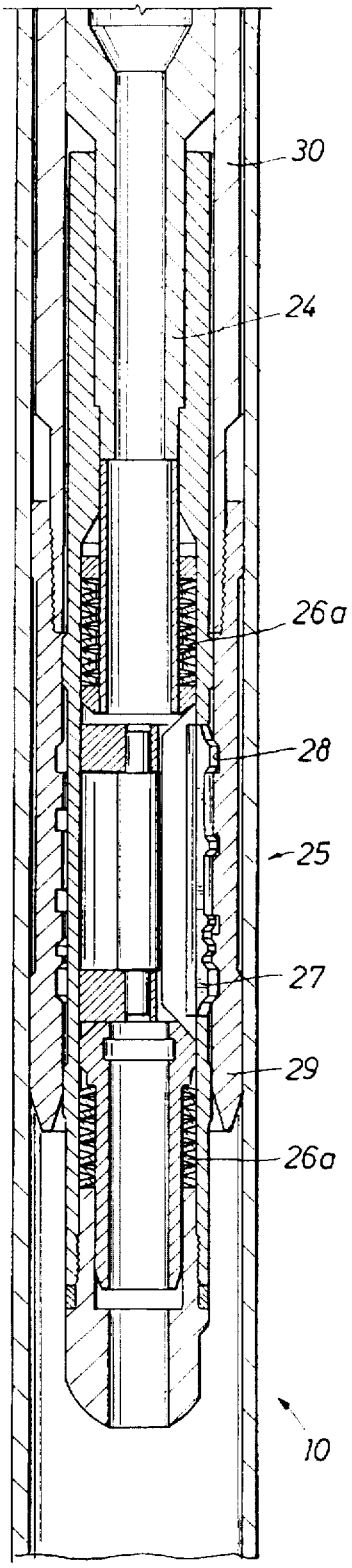

The tool of the present invention is indicated generally at 10 in FIG. 1 at a subsurface location within a surrounding well casing 11. A central mandrel 12 connects to a drill string 13 (FIG. 3) which in turn extends to the well surface (not illustrated). As will be hereinafter more fully explained, the drill string 13 is manipulated from the well surface to position and operate the tool 10.

The mandrel 12 extends through a tubular spline housing 14 at the upper end of the tool 10. The spline housing is secured to a tubular slotted mill housing 15 that is in turn connected at its lower end to an index slot mandrel 16. The lower end of the slot mandrel 16 necks down to a cylindrical slot surface section 17 that connects at its end to a mandrel latch section 18. A hydraulic seal sub-assembly 19 connects between the mandrel latch section 18 and a tubular mandrel release collet 20. The release collet 20 includes multiple collet fingers 21 having collet heads 22 that are held in radial recesses 23 in a surrounding mandrel housing 24. A hydraulic piston **20*a* having a retainer ring 26 at its lower end underlies the collet 20 with the ring 26 underlying the collet heads 22. The lower end of the housing 24 is surrounded by a dog retaining assembly indicated generally at 25 that employs upper and lower sets of Bellville spring washers 26*a* to urge contoured orienting and anchoring dogs 27 radially outwardly into engagement with slotted and grooved recesses 28 in the internal surface of an anchoring and orienting sleeve section 29. The upper end of the sleeve section 29 is connected to a tubular slip section 30. The slip section 30 carries hydraulically set slips 30*a* and weight set slips 30*b* that are used to anchor the slip section to the internal wall of the casing 11 to hold the slip section 30 and attached anchoring and orienting section 29** firmly in position within the casing.

Figure 13:
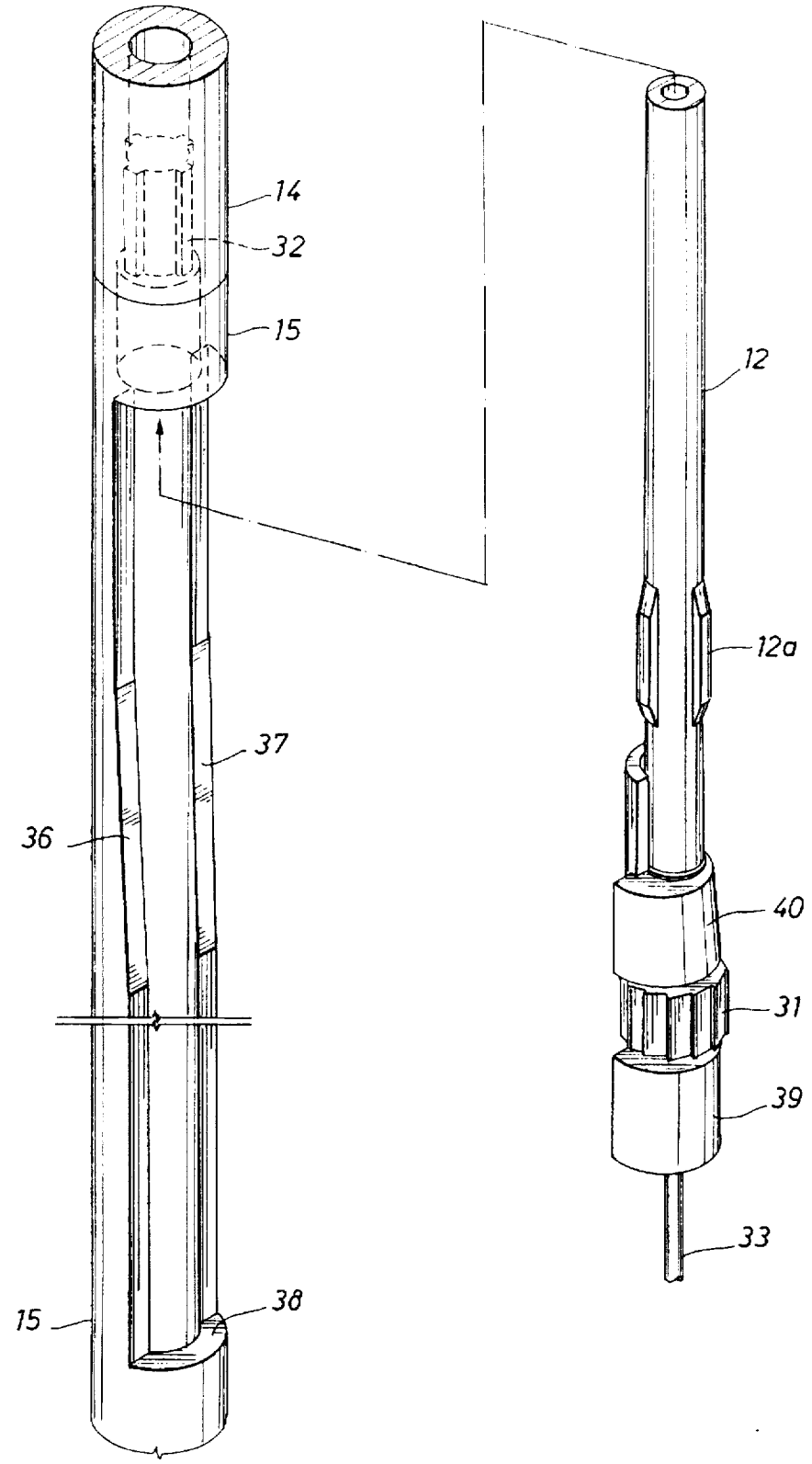
FIG. 13 is a perspective assembly view of the cutting tool, carriage mechanism and cutting assembly track of the present invention.

As thus far described, the tool 10 is comprised of four basic tool segments that may be moved longitudinally relative to each other. The first tool segment, herein referred to as the milling segment, is comprised of the central mandrel 12 that carries a cutting mill 31 at its lower end. Splines **12*a* carried on the mandrel 12 are adapted to be received in slots 32 formed in the spline sleeve 14. (See FIG. 13). When the slots 32 receive the splines 12*a*, rotation of the mandrel 12 relative to the housing 14** is prevented.

The second basic tool segment, or central segment, is comprised of the spline housing 14, mill housing 15, index slot mandrel 16, mandrel latch section 18, seal sub-assembly 19 and mandrel release collet 20.

The third basic tool segment, or release segment, is comprised of the mandrel housing 24 and dog retaining assembly 25.

The fourth basic tool segment, or anchor segment, is comprised of the anchoring sleeve 29 and the tubular slip section 30.

The tool 10 is run into the casing with the four basic segments fixed longitudinally relative to each other as best illustrated in FIG. 1. This running in configuration holds the slips **30*a* and 30*b* and mill 31 in radially retracted positions so that the combined assembly may be moved freely down through the casing 11. Once the tool is at the desired subsurface location within the casing 11, the tool is oriented with conventional orienting techniques so that the mill 30 is directed toward a selected geographic point. The anchor segment is then hydraulically set to hold the tool in place within the casing 11**. Setting of the anchor segment is followed by release of temporary holding components that functioned before setting the tool to prevent movement of the tool sections relative to each other. Once released, the milling section may be moved longitudinally and radially to cut the casing wall. Following a cut, the control segment may be moved longitudinally and angularly to index or shift the mill to a new circumferential cutting area along the casing. Following formation of all of the cuts, the release segment may be pulled free of the anchor segment to permit retrieval of the assembly comprised of the milling, control and release segments to the well surface. The anchor segment remains in place to provide an anchoring and orienting area within the casing that functions to receive, anchor and orient tools or other well equipment lowered into the well for additional work or installation of equipment relative to the casing window.

In operation, the assembly 10, as illustrated in FIG. 1, is lowered through the well casing 11 to the desired subsurface location, typically being a point immediately below that at which the casing window is to be formed. When properly positioned at this point, the tool 10 is oriented circumferentially so that the mill 31 is facing a desired geographic point or area. This may typically be a hydrocarbon bearing formation that is laterally offset from the main well bore. Once properly positioned and oriented, the tool is anchored in place within the casing 11 by a sequence of operations commencing with the application of hydrostatic pressure through the drill string 13. The hydrostatic pressure communicates from the drill string through the central mandrel 12, through a flexible fluid line 33, through the index slot mandrel 16, through the seal subassembly 19 and through radial ports 34 into the hydraulic setting structure acting on the slips 30*a*. The described setting procedure, which is conventional, causes the slips 30*a* to extend radially outwardly into firm gripping engagement with the internal wall of the casing 11. Once the slips 30*a* have set, the tool 10 is prevented from moving down the casing. Weight is then applied to the tool 10 through the drill string 13 in a conventional manner to set the slips 30*b*, which act to prevent upward movement of the tool 10. In a typical installation, the slips 30*a* are set with an application of hydrostatic pressure of approximately 1500 psi and the slips 30*b* are set with the application of approximately 10,000 pounds of weight on the tool 10.

Figure 2A:
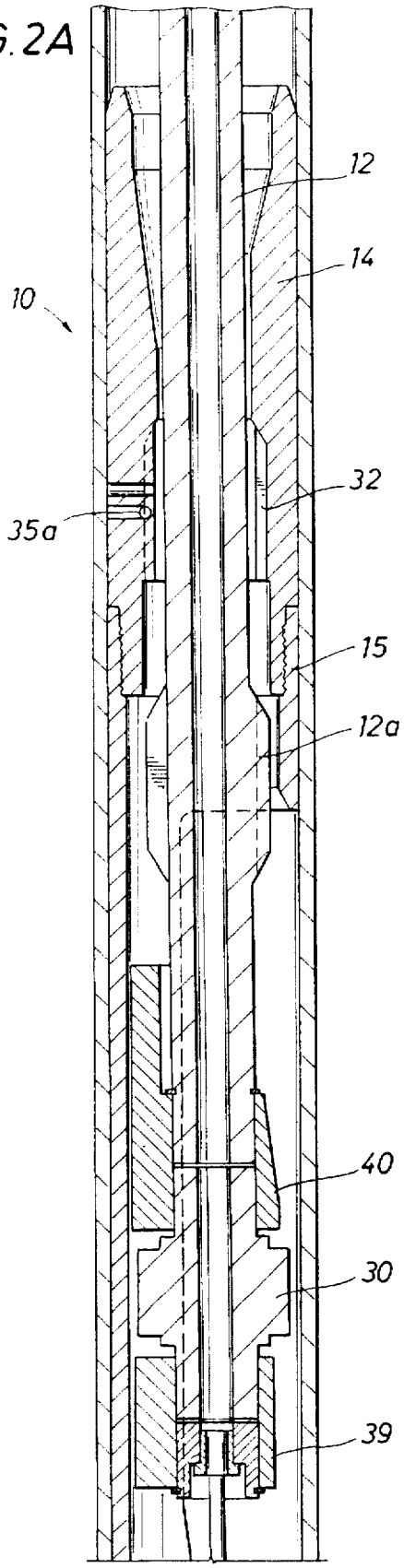
FIGS. 2A and 2B are vertical sectional views of two segments of the tool of the present invention illustrating the tool being prepared to mill an opening in the surrounding casing wall.
Figure 2B:
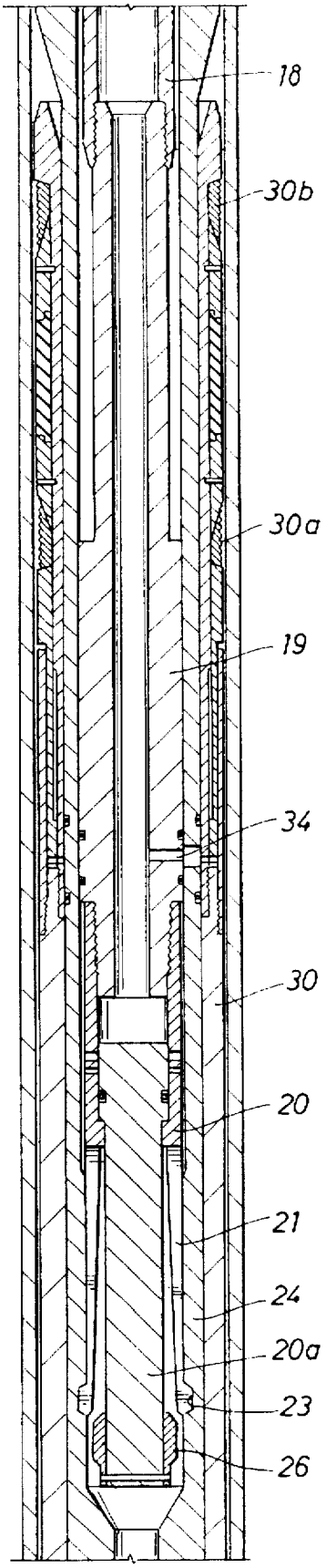

Once both slip sections 30*a* and 30*b* have been set, the hydrostatic pressure in the drill string is increased to approximately 2,500 psi to shear temporary restraining pins and force the hydraulic piston 20*a* down through the mandrel release collet 20 as best illustrated in FIG. 2. This downward shift of the piston 20*a* displaces the retainer ring 26 away from the collet heads 22 to free the collet (and attached central segment) for longitudinal movement relative to the surrounding release segment (mandrel 24) and anchor segment (slip section 30).

Following release of the control segment, the mill segment is released by increasing the amount of weight applied to the tool 10 to approximately 20,000 pounds, severing a temporary retaining shear pin 35 holding the central mandrel 12 to the spline housing 14. This action frees the milling segment to move longitudinally relative to the control segment. After shearing of the pin 35, a re-engageable detent 35*a* secures the central mandrel 12 to the control segment (housing 14). A force of approximately 4000 pounds is required to separate the mandrel 12 from the detent. The detent is automatically re-engaged with the mandrel 12 each time the spline is moved back to its starting point (illustrated in FIG. 1).

To initiate the first cut, the drill string 13 is lowered sufficiently to displace splines 12*a* on the mandrel 12 from receiving slots formed in the slot housing 14 to permit rotation of the mill 31. The drill string is then rotated and advanced downwardly to propel the mill 31 along sloped tracks 36 and 37 (see FIG. 13) through a mill housing opening 38 into contact with the surrounding casing wall. The mill 31 is supported between the tracks 36 and 37 by front and rear carriage mounts 39 and 40, respectively, that permit rotary motion of the bit while spacing the bit to prevent it from cutting the underlying mill housing.

Figure 3A:
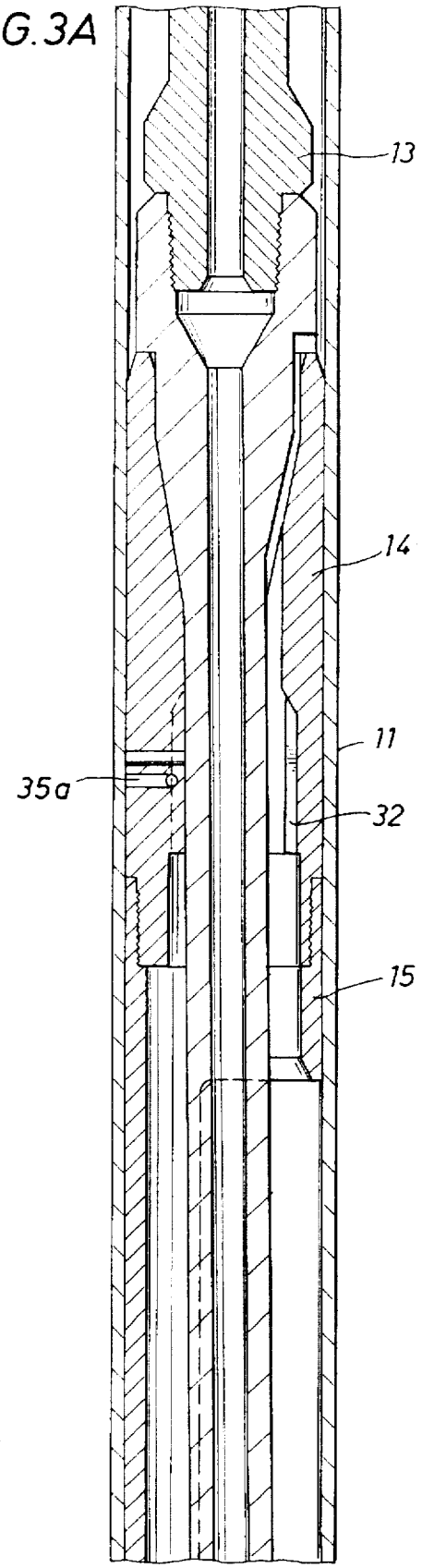
FIGS. 3A and 3B are vertical sectional views of two segments of the tool of the present invention illustrating the mill at the completion of a longitudinal opening cut into the casing.
Figure 3B:
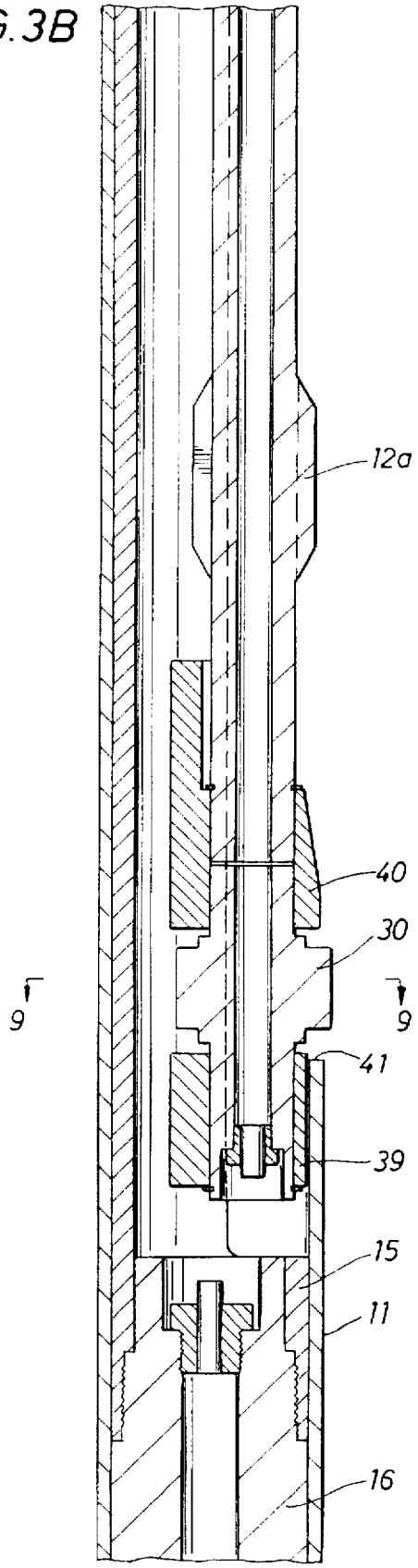
Figure 4A:
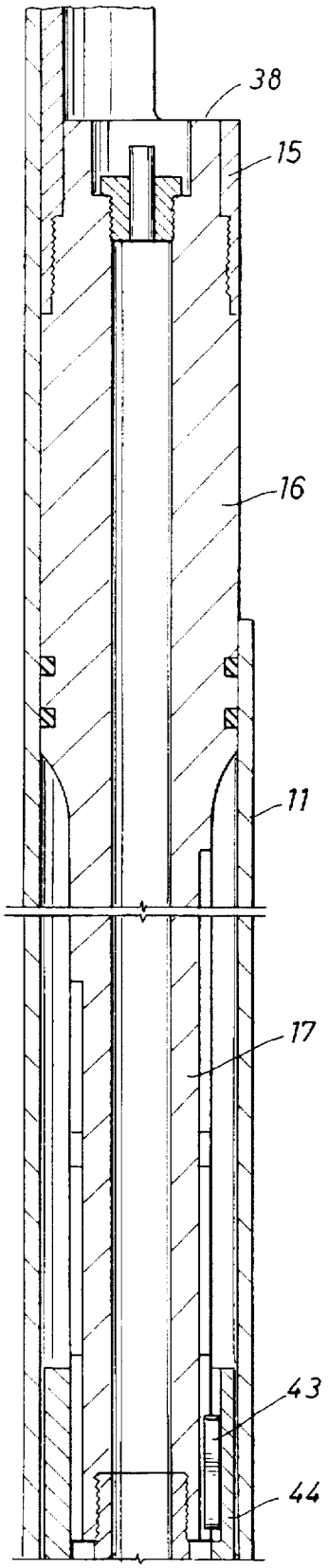
FIGS. 4A–4C are vertical sectional views of three segments of the tool of the present invention illustrating initial movement of the cutting tool as it is being indexed to a second circumferential position to form a second cut through the casing.
Figure 4B:
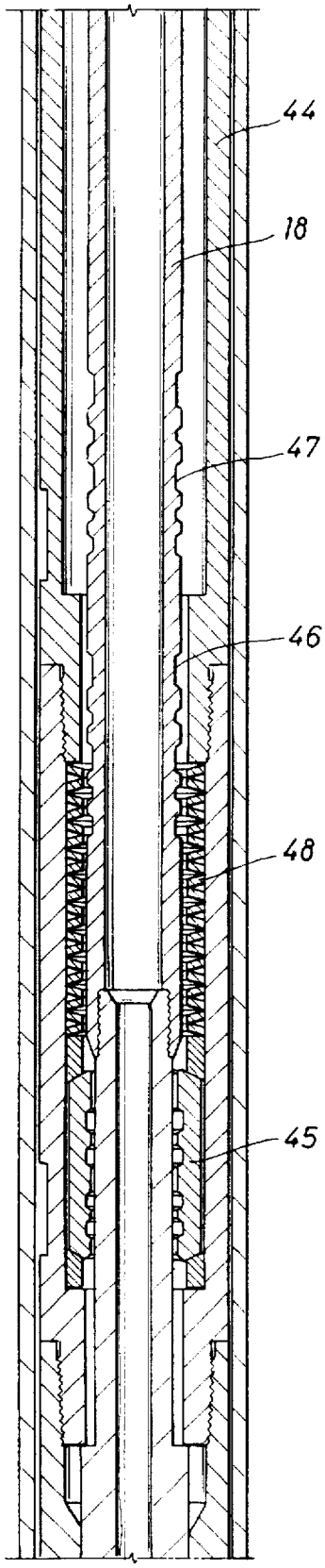
Figure 4C:
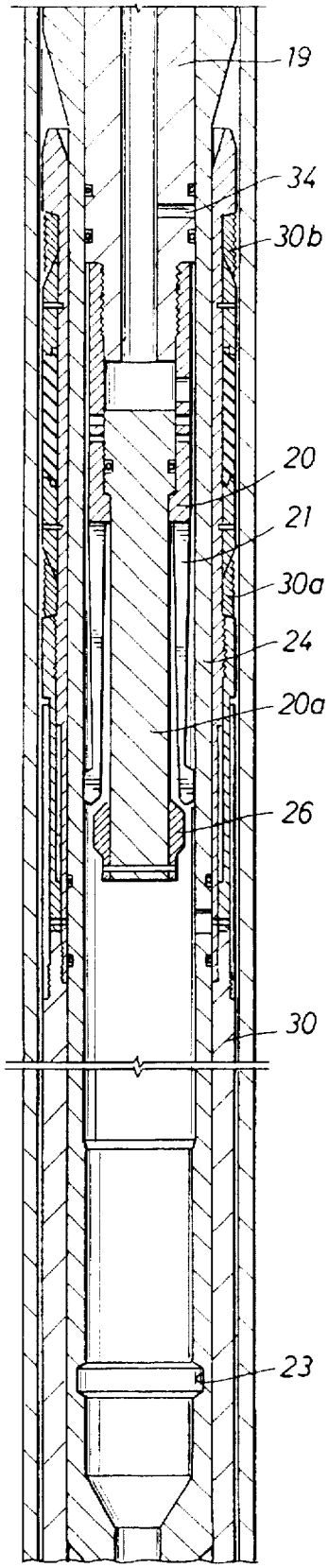
Figure 5A:
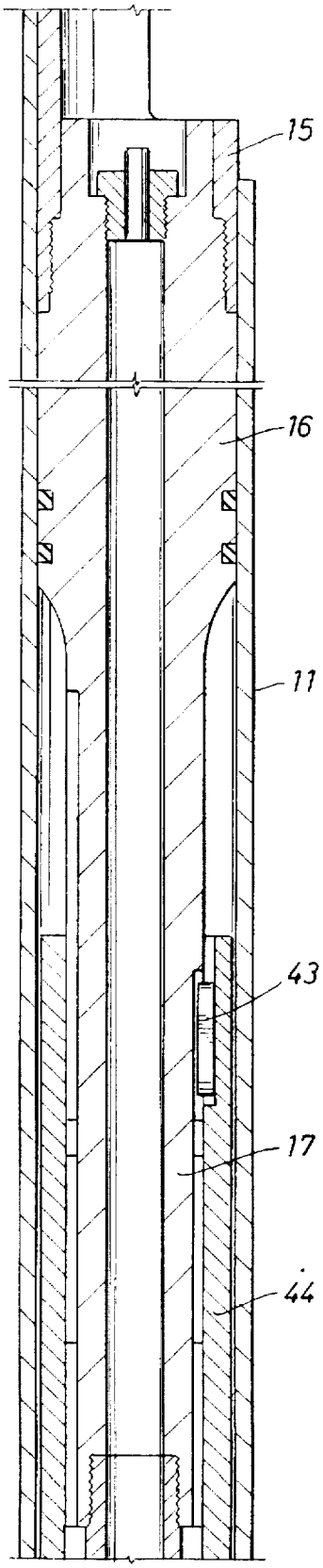
FIGS. 5A–5C are vertical sectional views of three segments of the tool of the present invention illustrating further movement of the indexing mechanism of the present invention as it is manipulated to position the cutting tool for the second cut.
Figure 5B:
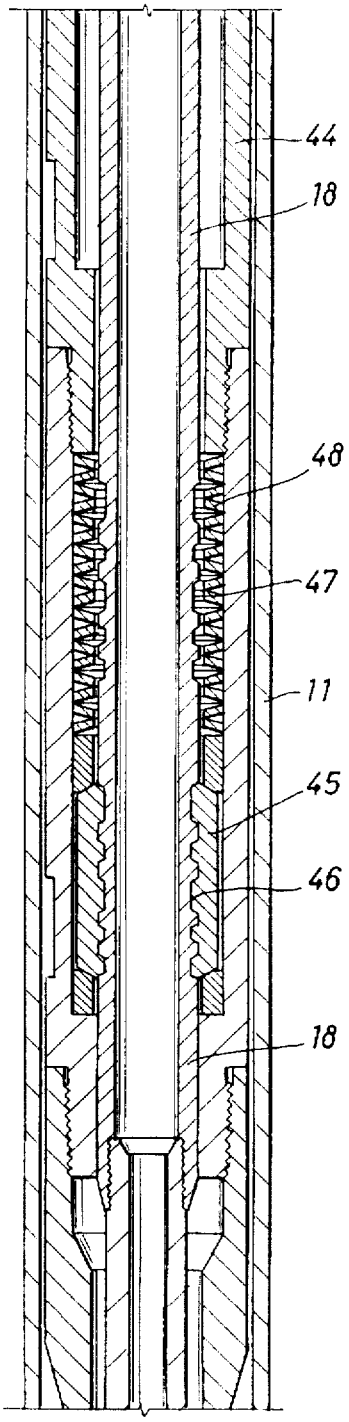
Figure 5C:
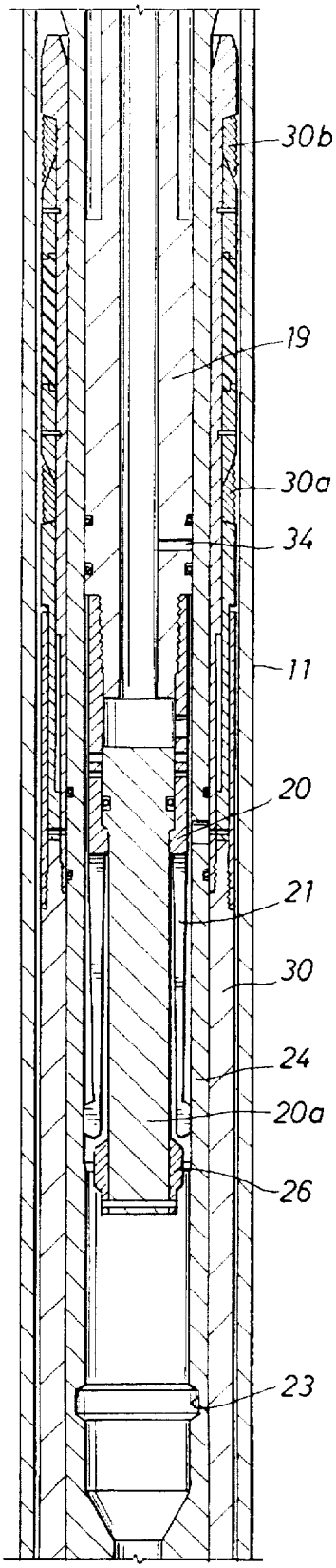

The initial rotation of the mill 31 ruptures the hydraulic fluid line 33. As the mill advances along the sloping tracks 36 and 37, it is slowly advanced into engagement with the casing wall to begin the cut with a minimum of offsetting forces that tend to cause the mill to drift in the direction of the cutting rotation. The cut becomes deeper during the initial mill travel, extending through the casing wall and slightly into the cement (not illustrated) or other material surrounding the casing. Once the mill cuts through the casing wall, the tracks direct the mill along a path substantially parallel to the axis of the tool 10 to form the major portion of the longitudinal casing cut which, as will be described, cooperates with subsequent longitudinal cuts to form a window 41 through the casing. The end of the mill cut is reached when the mill carriage mount 39 engages the end of the mill housing opening 38 as indicated in FIG. 3.

The second cut of the mill is accomplished by changing the angular position of the control segment (slot section 17) relative to the anchor segment (sleeve 29). The angular position of the control segment is changed by selectively lowering, raising and rotating the drill string 13 to advance a slot surface pattern 42 (see FIG. 6) formed on the external cylindrical surface of the slot section 17 over splines 43 positioned within a spline sleeve 44 at the upper end of the mandrel housing 24.

Figure 6:
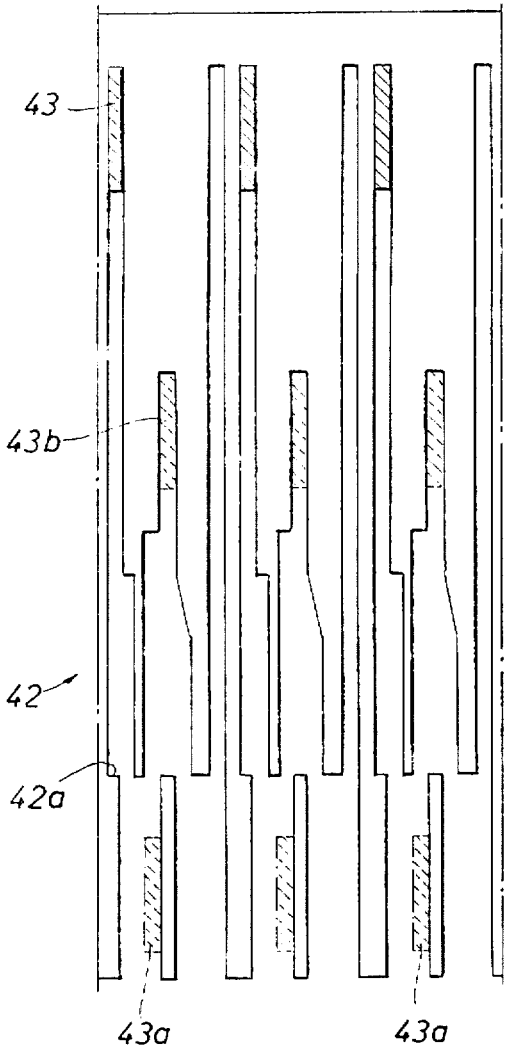
FIG. 6 is a schematic representation of the spline and slot pattern employed in indexing the cutting tool of the present invention for three separate cutting passes.

With reference to FIG. 6, the slot pattern 42 is configured to produce three separate angular positions of the milling segment (housing 15) relative to the control segment (slot mandrel 16). Each of the three angular positions is selected to be approximately 60° from the adjacent section so that, with a suitably sized mill 31, the three cuts combine to form a window of approximately 180° in circumferential development.

To place the milling segment in its next desired angular position after the first cut, the drill pipe 13 is initially raised until the splines 12*a* are received within the spline housing latching the detent 35*a* and then raised further to pull the control segment (slot mandrel 16) up through the release segment (spline sleeve 44). The milling segment is releasably secured to the control segment by spring loaded dogs 45 that mesh with recesses 46 or 47, formed on the mandrel latch section 18. The spring loading is imposed by a set of Bellville springs 48 that cooperate with tapered bearing surfaces to urge the dogs 45 radially inwardly against the mandrel latch section 18. The dogs 45 and recesses 46 and 47 have matching tapered contours that permit the dogs to be displaced longitudinally from the recesses when sufficient longitudinal force is exerted between the two components. In the illustrated form of the tool 10, an upward force of approximately 8,000 pounds is required to displace the dogs 45 upwardly from their engagement with the recess 46 or 47. Because of the contours of the dogs and recesses, a downward force on the control segment of approximately only 2000 pounds is required to displace the dogs 45 downwardly from the recesses 46 or 47.

After the application of the 8000 pound upward force, the milling segment (slot mandrel 16 and slot surface section 17) are free to move up until the recesses 46 and 47 have passed the dogs 45 and a shoulder 42*a* in slot 1 of the slot pattern engages the splines 43. The shoulder engagement is noted by a change in lifting force in the drill string 13 above the 8000 pound force required to move the two recesses 46 and 47 past the dogs 45. At this shouldering point, the drill string is torqued to the right to shift the lower end of slot 1 over the splines 43 to allow the mill segment to be moved relative to the splines 43 into the relative position illustrated by the dotted line representation 43*a* of the splines 43. (See FIG. 6). The drill string is then lowered while maintaining a right hand torque so that the slot pattern 42 advances over the splines 43 to move into the relative position indicated by the dotted line spline representation 43*b*. At this relative position of the spline sleeve 44 and slot pattern section 17, the dogs 45 are landed in the recess 46 to temporarily hold the milling assembly (mill housing 15) fixed relative to the control assembly (housing 24) during the formation of the second mill cut. It will be noted that the longitudinal position of the mill segment is higher when the mill segment is indexed in its second cut (spline in position 43*b*) to provide a window having a high center top opening.

Figure 11:
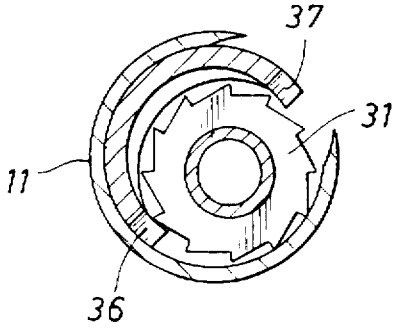
FIG. 11 is a lateral cross-sectional view illustrating the cutting tool retracted in preparation for a third pass cut.
Figure 12:
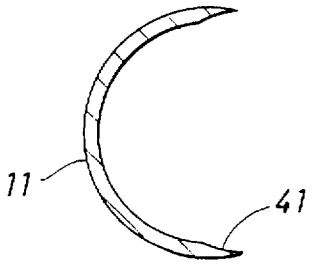
FIG. 12 is a lateral cross-sectional view taken along the line 12—12 of FIG. 7A illustrating a completed casing window with the cutting assembly retrieved.

With the milling segment and control segment thus aligned, the drill string 13 is lowered to release the detent 35*a* and move the splines 12*a* out of the spline housing 14. The drill string 13 is then lowered and rotated, as described previously, to cut a second cut in the casing wall to form a partial window as indicated in FIG. 11. Following completion of the second cut, the described sequence of drill pipe movement and torque is repeated to index the tool for the third cut to complete the window 41 as indicated in FIG. 12.

Figure 7A:
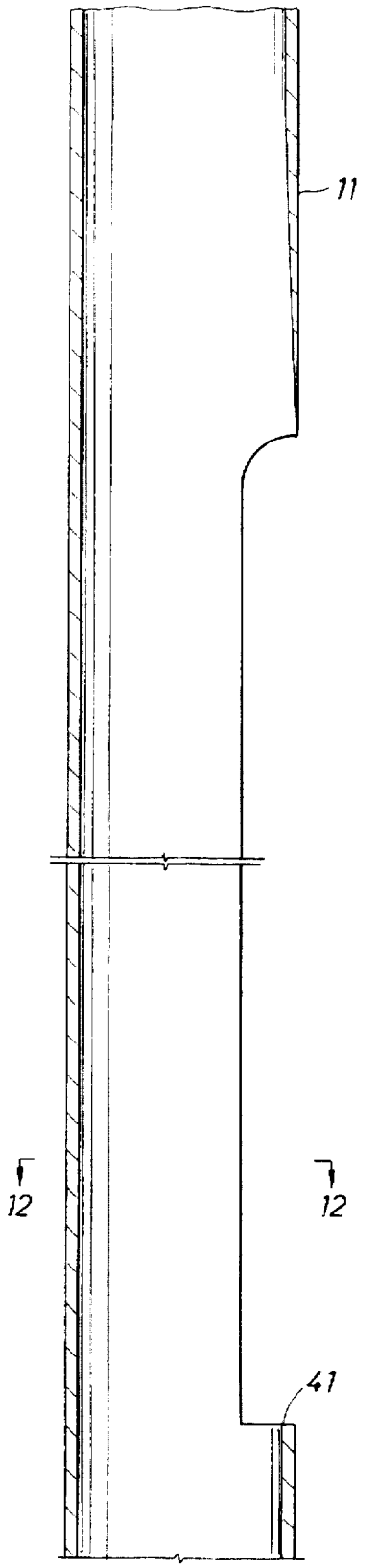
FIGS. 7A–7C are partial vertical sectional views of three segments of the completed casing window and installed anchoring and orienting sleeve of the present invention.
Figure 7B:
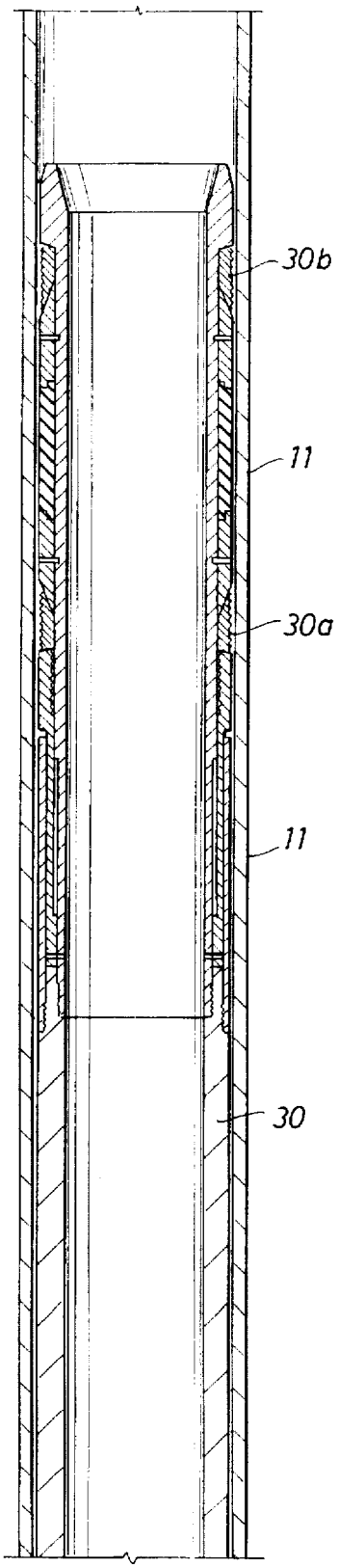
Figure 7C:
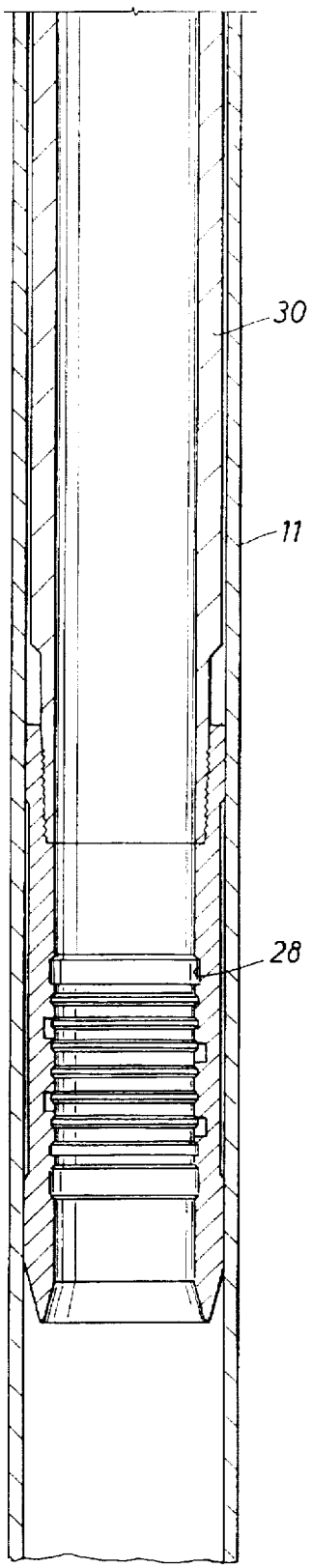
Figure 8:
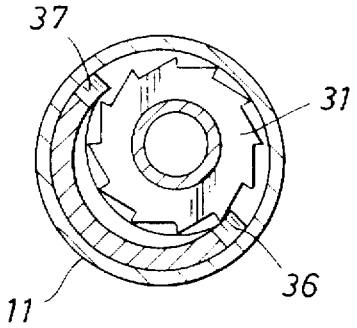
FIG. 8 is a lateral cross-sectional view of the cutting tool of the present invention taken along the line 8—8 of FIG. 1B.
Figure 9:
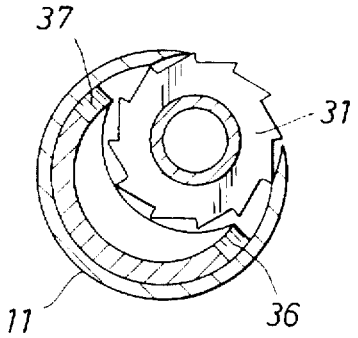
FIG. 9 is a lateral cross-sectional view of the cutting tool of the present invention taken along the line 9—9 of FIG. 3B.
Figure 10:
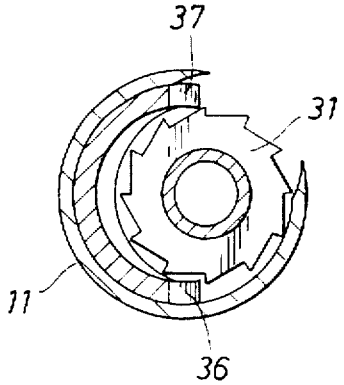
FIG. 10 is a lateral cross-sectional view illustrating the cutting tool retracted in preparation for a second pass cut.

Once the window has been fully cut, the milling segment, control segment and release segment are retrieved to the well surface as a unit. This is effected by exerting an upward pull on the drill string that pulls the dogs 27 free of the anchor recesses 28. An upward force of approximately 25,000 pounds is required to release the dogs. The anchor segment, illustrated in FIG. 7, remains fixed in place below the window 41 to be used at a later time for holding and orienting a whipstock or other subsurface tool or equipment that may be required to drill complete or workover the well. The tubular opening through anchor segment allows ready access to the well casing below the anchor.

Figure 14:
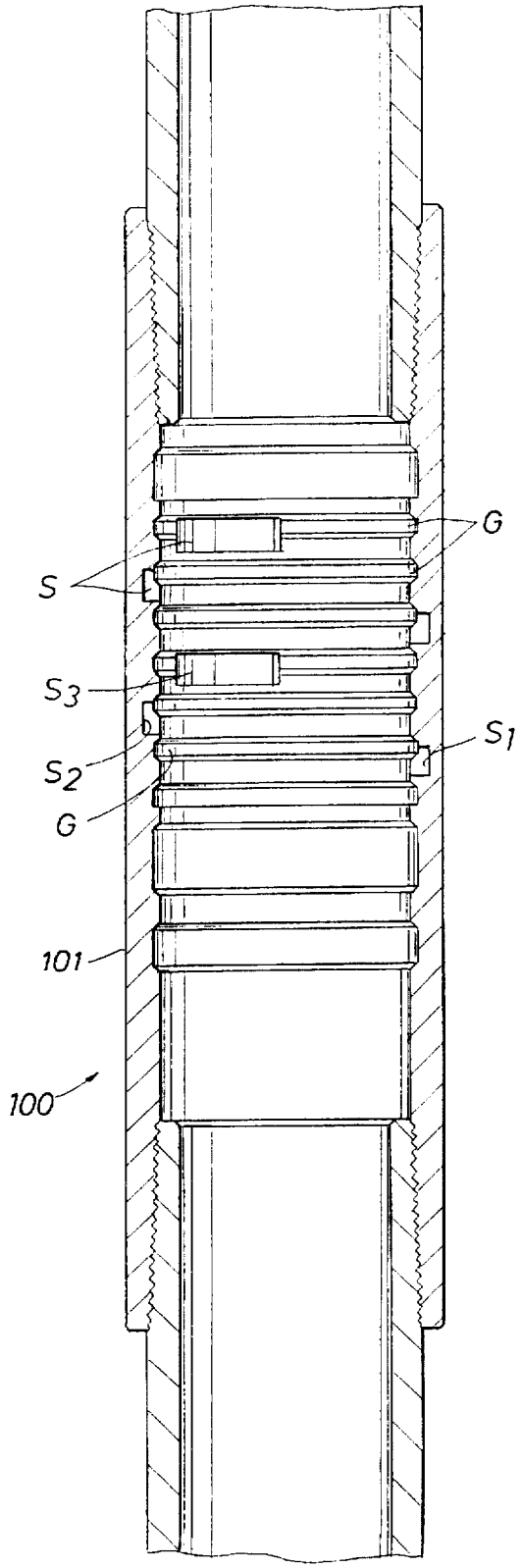
FIG. 14 is a partial vertical elevation illustrating a coupling in a casing string to be employed for anchoring and orienting the cutting assembly of the present invention.

FIG. 14 illustrates a modified form of the anchoring assembly, indicated generally at 100, that may be employed with the present invention. The assembly 100 is comprised of a casing coupling 101 having a pattern of slots S and grooves G that are adapted to mate with corresponding contours formed on the dogs 27 of the anchoring segment of the invention. The coupling 101, as more fully described in the related application hereinbefore identified, is placed in the casing string of a well when the well is initially drilled. The pattern and placement of the slots and grooves in the coupling 101 function similarly to those within the anchoring segment (sleeve 29) described in the first form of the invention.

When it becomes desirable to re-enter a well equipped with the coupling 101, the assembly substantially as retrieved from the set anchor segment of the previous embodiment is run into the well and landed in the coupling 101. The advantage of equipping the well with a coupling such as the coupling 101 is that the anchoring and orienting functions required for milling a casing window may be provided with a device that permits a fully open, or full drift, casing.

While the present invention has been described as forming three cuts to create a single window, it will be appreciated that four or five or more such cuts may be used. Also, while a window of 180° degree circumferential development was described, it will be understood that any desired size window may be formed. Similarly, while specific examples of force values required to free, index or otherwise control the formation of the window and the release from the anchor segment, it will be understood that the force values will vary depending on equipment size and other factors.

The foregoing disclosure and description of the invention is illustrative and explanatory thereof. It will be appreciated by those skilled in the art that various changes in the size, shape and materials, as well as in the details of the illustrated construction. The combinations of features and the method steps discussed herein may be made without departing from the spirit of the invention.

What is claimed is:

1. A tool for forming a subsurface window in the wall of a longitudinally extending well casing comprising:

a cutting assembly for cutting multiple, circumferentially spaced, longitudinally extending openings in said casing wall;

an anchoring mechanism for anchoring said cutting assembly to the internal wall surface of said well casing at a selected subsurface well location;

setting structure operable when set for engaging and gripping said anchoring mechanism within said well casing at a subsurface location with a selected orientation relative to a selected geographic point; and an indexing device connecting said cutting assembly and said setting structure for changing the circumferential location within said casing of said longitudinally extending openings whereby a window is formed through said casing wall by combined adjacent openings formed by said cutting assembly.

2. A tool as defined in claim 1, further comprising:

a release structure connecting said setting structure with said cutting assembly for selectively releasing said cutting assembly for removal from said setting structure after said setting structure is set; and an orienting and anchoring sleeve in said setting structure operable after release and removal of said cutting assembly, said sleeve comprising a tubular assembly concentric with said well casing and having internal wall contours for anchoring and orienting well equipment within said casing at a predetermined location relative to said window.

3. A tool as defined in claim 1, wherein said cutting assembly further comprises a carriage for supporting a cutting device for rotary, longitudinal and radial movement within said casing.

4. A tool as defined in claim 3, wherein said cutting device comprises a rotary mill.

5. A tool as defined in claim 4, further comprising a sloping track support section for said carriage for forming an increasingly deeper cut in said casing wall as said rotary mill is advanced along said sloping track support.

6. A tool as defined in claim 4, further comprising dual track supports for mounting said carriage with said rotary mill centrally disposed between said dual track supports with at least a portion of said dual track support sloping away from the central axis of said casing.

7. A tool as defined in claim 5, further comprising dual track supports for mounting said carriage with said rotary mill centrally disposed between said dual track supports.

8. A tool as defined in claim 7, further comprising a hydraulically actuated release structure connecting said setting structure with said cutting assembly for selectively releasing said cutting assembly for removal from said setting structure after said setting structure is set.

9. A tool as defined in claim 8, further comprising:

hydraulically actuated gripping mechanisms in said setting structure operable when actuated for preventing downward movement of said setting structure within said well casing; and weight actuated gripping mechanisms operable after said hydraulically actuated mechanisms are actuated for preventing upward movement of said setting structure within said well casing.

10. A tool as defined in claim 1, further comprising:

hydraulically actuated gripping mechanisms in said setting structure operable when actuated for preventing downward movement of said setting structure within said well casing; and weight actuated gripping mechanisms operable after said hydraulically actuated mechanisms are actuated for preventing upward movement of said setting structure within said well casing.

11. A tool as defined in claim 1, further comprising a hydraulically actuated release structure connecting said setting structure with said cutting assembly for selectively releasing said cutting assembly for removal from said setting structure after said setting structure is set.

12. A method for forming a subsurface window in a well casing comprising the steps of:

placing a cutting tool at a desired subsurface location within a well casing;

orienting the tool to a first cutting position;

cutting a first longitudinally extending opening through the wall of said casing at said first cutting position;

moving the tool to a second cutting position circumferentially spaced from said first cutting position;

cutting a second longitudinally extending opening through the wall of the casing at a second cutting position, said second opening being adjacent to said first opening to form a combined opening having a circumferential development greater than that of either of said first or second openings; and retrieving the cutting tool to the well surface.

13. A method as defined in claim 12, further comprising the steps of:

anchoring the cutting tool within the casing with an anchoring and orienting device; and separating the cutting tool from the anchoring and orienting device.

14. A method as defined in claim 13, further comprising the step of orienting well equipment with the anchoring and orienting device whereby oriented subsurface well procedures may be performed with the well equipment.

15. A method as defined in claim 13, further comprising the step of placing the anchoring and orienting device into the well casing during the placement of the cutting tool.

16. A method as defined in claim 12, further comprising the step of moving a cutting element in the cutting tool to different circumferential positions relative to the tool for cutting said longitudinally extending openings.

17. A method as defined in claim 16, further comprising the step of moving the cutting tool to three different cutting positions spaced approximately 60° from each other to form a casing window having approximately 180° of circumferential development.

18. A method as defined in claim 12, further including the steps of:

locking the cutting tool at said first cutting position to prevent circumferential movement of the tool relative to the casing;

releasing the cutting tool from its locked condition at said first cutting position;

moving the cutting tool to said second cutting position; and locking the tool in said second cutting position to prevent circumferential movement of the tool relative to the casing.

19. A method as defined in claim 18, further including the steps of rotating and longitudinally moving the cutting tool to lock and release the tool at a said first and second cutting positions.

20. A method as defined in claim 18, further comprising the steps of:

biasing the cutting tool to remain longitudinally fixed at first and second longitudinal positions with the casing as a cutting head in said tool is moved longitudinally relative to the casing; and overcoming the biasing on said cutting tool to move the tool longitudinally within the casing.

21. A method as defined in claim 12, further comprising the steps of:

anchoring the cutting tool within the casing with an anchoring and orienting device; and setting the anchoring and orienting device with hydraulic pressure and weight to prevent longitudinal movement of the anchoring and orienting device through the well casing.

22. A method as defined in claim 15, further comprising the step of orienting well equipment with the anchoring and orienting device whereby oriented subsurface well procedures may be performed with the well equipment.

23. A method as defined in claim 22, further comprising the step of anchoring well equipment with the anchoring and orienting device.

24. A method as defined in claim 15, further comprising the step of anchoring well equipment with the anchoring and orienting device.

25. A system for forming a subsurface window in the wall of a longitudinally extending well casing comprising:

an anchoring area positioned at a first subsurface location along the internal surface of said well casing;

a window cutting assembly for cutting a window in said casing at a second subsurface location;

an anchoring mechanism connected with said cutting assembly for selectively engaging and anchoring said cutting assembly to said anchoring area for holding said cutting assembly while said window is cut in said casing;

an orienting system for orienting said cutting assembly relative to a selected geographic point whereby said window is cut at a known circumferential position in said casing;

a cutting mechanism carried in said cutting assembly for forming a first longitudinally extending cut through said casing at said second surface location; and an indexing device for changing the circumferential position of said cutting mechanism for forming a second longitudinally extending cut through said casing, said second cut being adjacent said first cut whereby said first and second cuts combine to form a window through said second cut.

26. A system as defined in claim 25, further comprising a release structure carried in said anchoring mechanism for releasing said anchoring mechanism and cutting assembly from said anchoring area after said window is formed.

27. A system as defined in claim 25, wherein said indexing device changes the circumferential position of said cutting mechanism relative to said anchoring mechanism.

28. A system as defined in claim 25, wherein said cutting mechanism comprises a rotary mill.

29. A system as defined in claim 28, further comprising:

a carriage for supporting said rotary mill for rotary, longitudinal and radial movement within said casing; and an elongate track carried by said cutting assembly, said track having at least a portion of its length sloping toward said casing wall for moving said carriage radially as said carriage moves longitudinally over said track, said track being configured to support said carriage and mill whereby said mill may rotate to cut said casing without cutting said cutting assembly.

30. A system as defined in claim 25, wherein said anchoring mechanism comprises casing coupling connecting sections of said casing together.

31. A system as defined in claim 30, wherein said casing coupling includes an internal surface having multiple contours adapted to engage and mate with corresponding contours of said anchoring mechanism for anchoring and orienting said cutting assembly.

32. A system as defined in claim 30, further comprising a release structure in said anchoring mechanism for releasing said anchoring mechanism and cutting assembly from said anchoring area after said window is formed.

33. A system as defined in claim 32, wherein said anchoring area comprises a coupling connecting sections of said casing together.

34. A system as defined in claim 33, wherein said cutting mechanism comprises a rotary mill.

35. A system as defined in claim 34, further comprising:

a carriage for supporting said rotary mill for rotary, longitudinal and radial movement relative to said casing; and a track carried by said cutting assembly having a sloping section for moving said carriage radially as said carriage moves longitudinally over said track, said track being configured to support said carriage and said mill whereby said mill may cut said casing without cutting said cutting assembly.

* * * * *